United States Patent [19]

Richardson

[11] Patent Number: 4,957,299

[45] Date of Patent: Sep. 18, 1990

[54] BALLOON TOY AND GAME

[76] Inventor: Royest L. Richardson, 305 West Home, Flint, Mich. 48505

[21] Appl. No.: 345,271

[22] Filed: May 1, 1989

[51] Int. Cl.[5] ..... A63F 9/00

[52] U.S. Cl. ..... 273/409; 273/1 R; 446/225

[58] Field of Search ..... 273/409, 1 R; 446/45, 446/56, 61, 63, 187, 220, 225

[56] References Cited

U.S. PATENT DOCUMENTS

| | | | |
|---|---|---|---|
| 262,517 | 8/1882 | Unz et al. | 446/220 |
| 1,516,919 | 11/1924 | Gordon | 446/225 |
| 2,449,147 | 9/1948 | Samuels | 446/187 |
| 2,763,958 | 9/1956 | Leimelson | 446/225 |
| 3,596,909 | 8/1971 | Russ | 273/409 X |

*Primary Examiner*—William H. Grieb
*Attorney, Agent, or Firm*—Donald C. Bolger

[57] ABSTRACT

A child's toy which can also be used as a game. The game consists of a game board and a balloon launching device called a "balloon fly". The game board is made from a flat piece of paper or cardboard and is divided into 9 area, marked 1, 2, 3, 4, 5, 6, 7, 9, 10. Next to the number 2 are the words "Free Fly" which gives an extra turn when the "balloon fly" lands on this space. To play the game, a child blows on the open end of the "balloon fly" until the balloon is expanded with sufficient air to reach the game board. The child then puts his finger over the open end of "balloon fly" to hold the air inside of the balloon. Next, the child adjusts the wing at a conjectured setting and then aims the "balloon fly" towards the game board. When the child feels that his settings and aim are completed, the child's finger is released from the "balloon fly" and exiting air causes the "balloon fly" to be launched toward the game board. Points are scored when the "balloon fly" lands on a game board number.

19 Claims, 2 Drawing Sheets

| | | |
|---|---|---|
| 5 | 9 | 10 |
| 4 | 2<br>FREE FLY | 3 |
| 1 | 7 | 6 |

BALLOON TOY AND GAME

CROSS-REFERENCE TO RELATED APPLICATIONS: NONE

Statement as to right to inventions made under Federally sponsored research and development: Not Applicable.

BACKGROUND OF THE INVENTION

The field of the invention is generally that of amusing toy and game and more specifically a game for young children that will help children in learning mathematic and aeronautical skills.

The prior art includes games of many kinds that include scoring by adding numbers. However, when playing number games children get bored and loose interest in playing because wining the game is by pure chance.

Another problem encountered frequently is that many of the games are played over too long of a period and children loose interest.

SUMMARY OF THE INVENTION

Generally speaking, the present invention comprises a novel toy and game board that develops skills in mathematics and aerodynamics.

Furthermore, in one preferred form, the balloon game can be used as an amusement device.

Also, in one preferred form, the balloon game can be used as a toy.

It is an object of the present invention to provide a novel child's game which is inexpensive.

It is a further object of the invention to provide a novel game that can also be used as a toy.

It is a further object of the invention to provide game that will indirectly develop abilities in mathematics and aerodynamics.

It is a further object of the invention to provide toy that is illuminated so that the game can be played during the nighttime.

Further objects are implicit in the detailed description which follows hereinafter (which is to be considered as exemplary of, but not specifically limiting, the present invention) and said objects will be apparent to persons skilled in the art after a careful study of the detailed description which follows.

For the purpose of clarifying the nature of the present invention, one exemplary embodiment of the invention is illustrated in the hereinbelow-described figures of the accompanying drawings and is described in detail hereinafter. It is to be taken as representative of the multiple embodiments of the invention which lie within the scope of the invention.

DESCRIPTION OF THE PREFERRED EMBODIMENTS

The game consists of a game board and a balloon launching device called a "balloon fly".

Figures 1, 2:
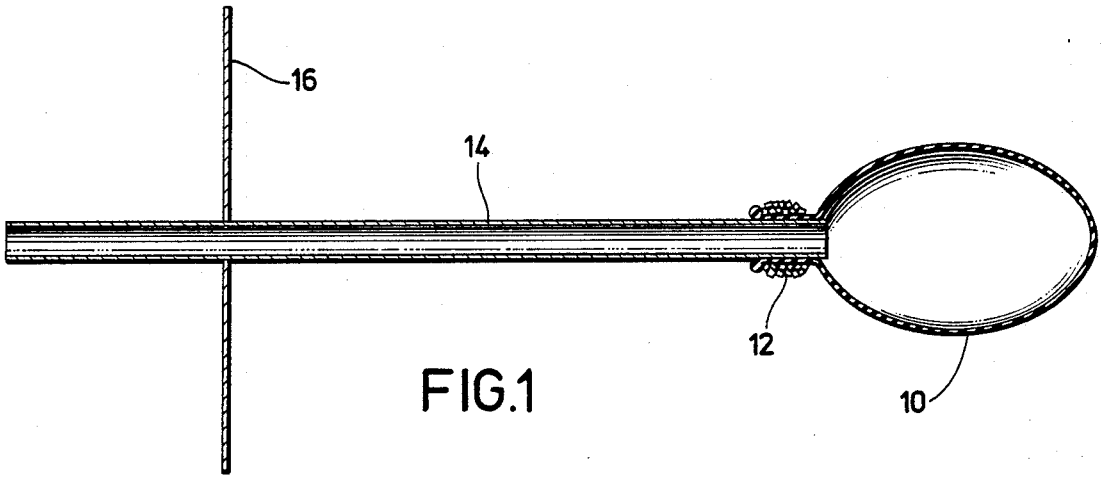
FIG. 1 is a cross-sectional view showing one exemplary embodiment of one representative form of a "balloon fly".
FIG. 2 is a top view of one exemplary embodiment of one representative form of the game board.
Figure 3:
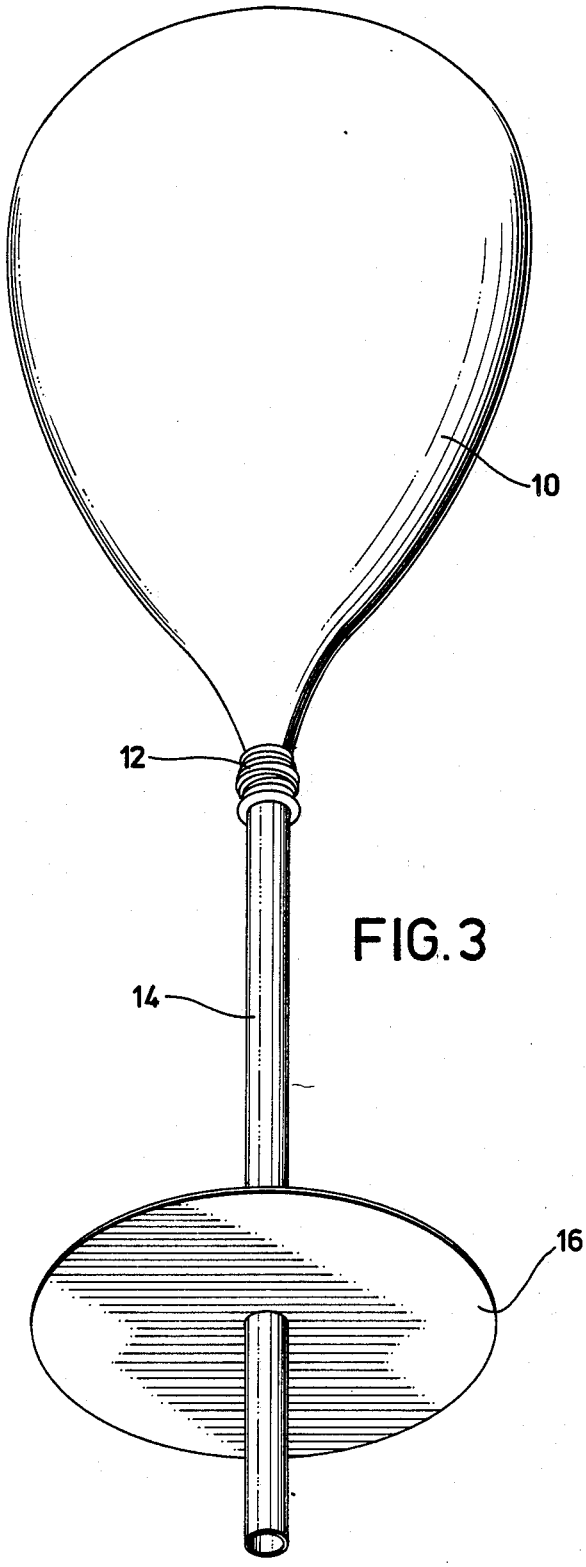
FIG. 3 is a perspective view showing one exemplary embodiment of one representative form of the "balloon fly".

Referring to FIG. 1, the balloon fly has drinking straw 14 inserted into the opening of balloon 10 with rubber band 12 used to secure balloon 10 to drinking straw 14. Wing 16 is connected to drinking straw 14 with tape and can be adjusted by moving wing 16 closer or farther away from balloon 10.

The balloon is attached to the end of the tube by a friction fit. The wing is attached to the main portion of the tube by a friction fit or a piece of tape. A string can be attached to the tube to act as a tail. The tube and wing can be painted with an illuminated paint whereby the device will glow in the dark.

Referring to FIG. 2, the game board is made from a flat piece of paper or cardboard. The board is divided into 9 area, marked 1, 2, 3, 4, 5, 6, 7, 9, 10. Next to the number 2 are the words "Free Fly" which gives an extra turn when the "balloon fly" lands on this space.

The game board is placed near a wall or door on a flat surface. To play the game, a child blows on the open end of the "balloon fly" until the balloon is expanded with sufficient air to reach the game board. The child then puts his finger over the open end of "balloon fly" to hold the air inside of the balloon. Next, the child adjusts the wing at a conjectured setting and then aims the "balloon fly" towards the game board. When the child feels that his settings and aim are completed, the child's finger is released from drinking straw 14 and the exiting air causes the "balloon fly" to be launched toward the game board.

Points are given when the "balloon fly" lands on a game board number. The first person to get 50 points wins the game.

It should be understood that the figures and the specific description thereof set forth in this application are for the purpose of illustrating the present invention and are not to be construed as limiting the present invention to the precise and detailed specific structures shown in the drawing figures and specifically described hereinbefore. Rather, the real invention is intended to include substantially equivalent constructions embodying the basic teachings and inventive concept of the present invention.

What is claimed is:

1. An amusement device in combination with a game board, comprising:

a balloon;

a tube having a first end, a second end, main portion;

a wing having flexibility;

means for attaching the balloon to the first end of the tube;

means for attaching the wing to the main portion of the tube.

2. An amusement device as recited in claim 1, whereby the means for attaching the balloon to the first end of the tube is a friction fit.

3. An amusement device as recited in claim 1, whereby the means for attaching the wing to the main portion of the tube is a friction fit.

4. An amusement device as recited in claim 1, whereby the means for attaching the balloon to the first end of the tube is a rubber band.

5. An amusement device as recited in claim 1, whereby the means for attaching the wing to the main portion of the tube is a piece of tape.

6. An amusement device as recited in claim 1, whereby a piece of string is attached to the tube whereby the string acts as a tail in stabilizing the flight of the device.

7. An amusement device in combination with a game board, comprising:

a balloon;

a tube having a first end, a second end, main portion;

a flexible wing having a disc shape with a hole in the center;

means for attaching the balloon to the first end of the tube;

means for attaching the wing to the main portion of the tube.

8. An amusement device as recited in claim 7, whereby the means for attaching the balloon to the first end of the tube is a friction fit.

9. An amusement device as recited in claim 7, whereby the means for attaching the wing to the main portion of the tube is a friction fit.

10. An amusement device as recited in claim 7, whereby the means for attaching the balloon to the first end of the tube is a rubber band.

11. An amusement device as recited in claim 7, whereby the means for attaching the wing to the main portion of the tube is a piece of tape.

12. An amusement device as recited in claim 7, whereby a piece of string is attached to the tube whereby the string acts as a tail in the flight of the device.

13. An amusement device in combination with a game board, comprising:

a balloon having an elliptical shape;

a tube having a first end, a second end, main portion;

a flexible wing having a disc shape with a hole in the center;

means for attaching the balloon to the first end of the tube;

means for attaching the wing to the main portion of the tube.

14. An amusement device as recited in claim 13, whereby the means for attaching the balloon to the first end of the tube is a friction fit.

15. An amusement device as recited in claim 13, whereby the means for attaching the wing to the main portion of the tube is a friction fit.

16. An amusement device as recited in claim 13, whereby the means for attaching the balloon to the first end of the tube is a rubber band.

17. An amusement device as recited in claim 13, whereby the means for attaching the wing to the main portion of the tube is a piece of tape.

18. An amusement device as recited in claim 13, whereby a piece of string is attached to the tube whereby the string acts as a tail in stabilizing the flight of the device.

19. An amusement device as recited in claim 13, wherein the tube and wing are painted with an illuminated paint whereby the device will glow in the dark.

* * * * *